US006056182A

United States Patent [19]

Chen

[11] Patent Number: 6,056,182

[45] Date of Patent: May 2, 2000

[54] STAPLE EJECTION DEVICE FOR A POWER STAPLER

[76] Inventor: Wilson Chen, No. 9, Industry 16th.Road, Taiping City, Taichung Hsien, Taiwan

[21] Appl. No.: 09/383,221

[22] Filed: Aug. 26, 1999

[51] Int. Cl.[7] ..... B25C 1/04

[52] U.S. Cl. ..... 227/123; 227/128

[58] Field of Search ..... 227/123, 127, 227/128, 120

[56] References Cited

U.S. PATENT DOCUMENTS

| | | | |
|---|---|---|---|
| 4,436,236 | 3/1984 | Jobe | 227/123 |
| 4,467,952 | 8/1984 | Morrell, Jr. | 227/120 |
| 4,549,681 | 10/1985 | Yamamoto et al. | 227/123 |
| 4,641,772 | 2/1987 | Skuthan | 227/123 |
| 4,688,710 | 8/1987 | Massari, Jr. et al. | 227/128 |
| 5,642,849 | 7/1997 | Chen | 227/123 |

*Primary Examiner*—Scott A. Smith
*Attorney, Agent, or Firm*—Bacon & Thomas

[57] ABSTRACT

A staple ejection device for a power stapler includes a guide plate having two hooks, a strip and a cover member are respectively and pivotally connected to the two lugs. The cover member has a retaining plate which defines a gap between the retaining plate and the cover member. A control member is retained in the gap between the retaining plate and the cover member, two springs biased between the control member and a positioning block of the cover member so that the control member is movable in the gap. The control member has two buttons each of which has a cone-shaped end which is engaged with the hook on the guide plate. The cover member is pivoted away from the guide plate by pulling the buttons to disengage the two buttons from the hooks.

6 Claims, 5 Drawing Sheets

STAPLE EJECTION DEVICE FOR A POWER STAPLER

FIELD OF THE INVENTION

The present invention relates to a staple ejection device for a power stapler wherein the guide plate has two hooks and a cover member is pivotally connected to the guide plate, a locking member urged by a spring and connected between the cover and the hooks so that the cover member is easily pivoted away from the guide plate to deal with problems of staples jam.

BACKGROUND OF THE INVENTION

A staple ejection device 40 for a power stapler is shown in FIG. 6 and generally includes a guide plate 41 in which a groove 410 is defined and a pushing plate is movably received in the groove 410. A cover member 42 is pivotally connected to the top of the guide plate 41 by a locking means. The locking means includes a lever 43 with a locking ring 341 which is pivotally connected to the lever 43 about a different pin of that of the lever 43. The locking ring 341 is locked to two hooks 411 extending from the guide plate 41 so as to connect the cover member 42 to the guide plate 41. The guide plate is connected to the barrel of the stapler so that the pushing plate is actuated by the piston in the barrel, and the guide plate also connected to a top of a staple magazine so that the staples in the magazine will by pushed toward the guide plate and when the pushing plate is actuated, the upper most staple will be ejected by the pushing plate. In order to deal with problems of staple jam, the lever 43 can be lifted and to loose the engagement between the locking ring 431 and the hooks 411 so that the locking ring 431 can be disengaged from the hooks 41 1, and the cover member 42 can be removed from the guide plate 41 to check the staples. Nevertheless, to pull the lever 43 up or to push the lever 43 down requires a great effort so that it is not good enough for the users.

The present invention intends to provide an improved staple ejection device for a power stapler wherein the cover member is easily pivoted from the guide plate by pushing a control member urged by springs. This device of the present invention mitigates the shortcomings of the conventional staple ejection device.

SUMMARY OF THE INVENTION

In accordance with one aspect of the present invention, a staple ejection device for a power stapler is provided and comprises a guide plate connected to the barrel of the power stapler and a groove is defined in the guide plate. Two hooks and two lugs respectively extend from a surface of the guide plate. A strip member has one end thereof pivotally connected between the two lugs and is received in the groove. A cover member is pivotally connected to the two lugs of the guide plate and has a retaining plate which defines a gap between the retaining plate and the cover member. A control member is movably inserted into the gap and has two buttons on two sides of the control member. The two buttons are engaged with the two hooks on the guide plate and a biasing means is biased between the positioning block and the two buttons.

The main object of the present invention is to provide a staple ejection device for a power stapler wherein the cover member is easily pivoted away from the guide plate by pulling a control member which is respectively connected between the cover member and the guide plate.

Another object of the present invention is to provide a control member which is easily operated by a limited effort.

Further objects, advantages, and features of the present invention will become apparent from the following detailed description with appropriate reference to the accompanying drawings.

DETAILED DESCRIPTION OF THE PREFERRED EMBODIMENT

Figure 1:
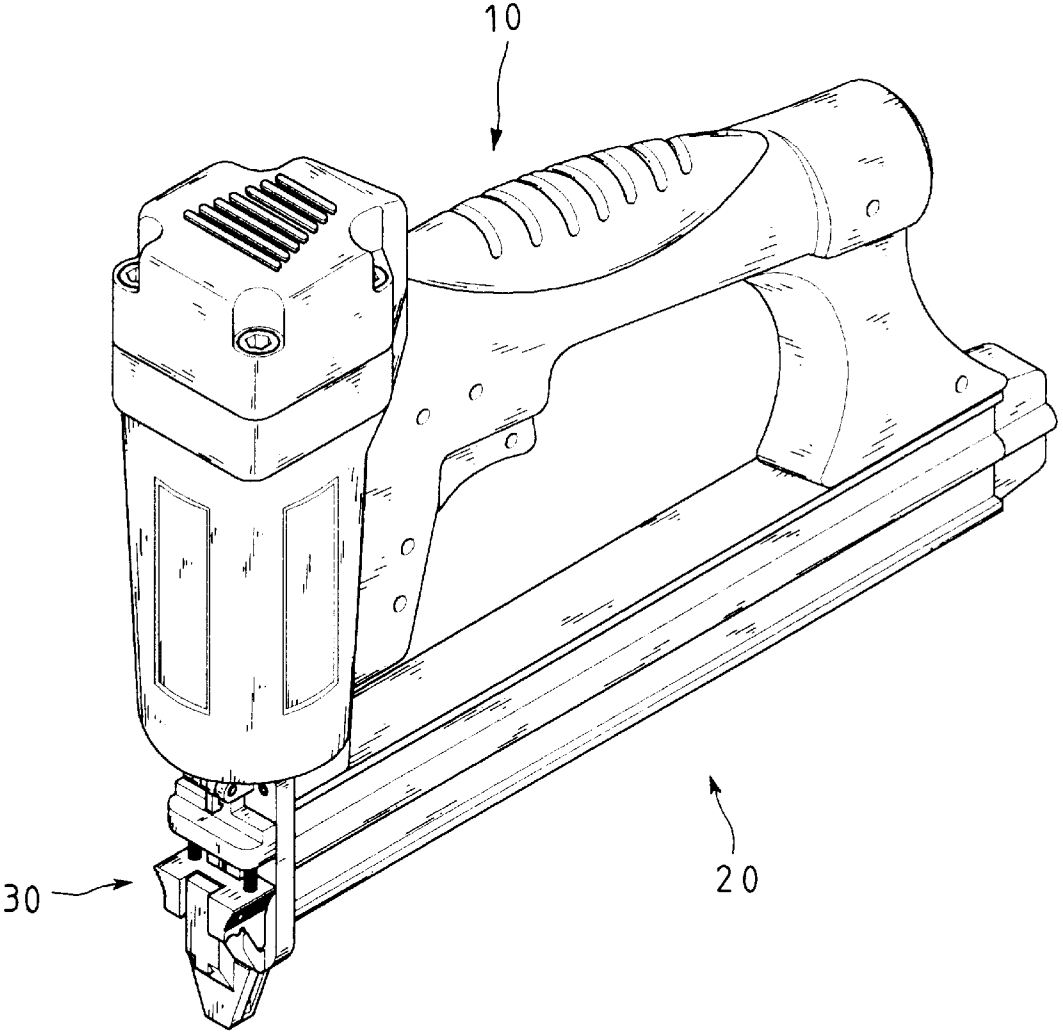
FIG. 1 is a perspective view of a power stapler with the staple ejection device of the present invention connected thereto.
Figure 2:
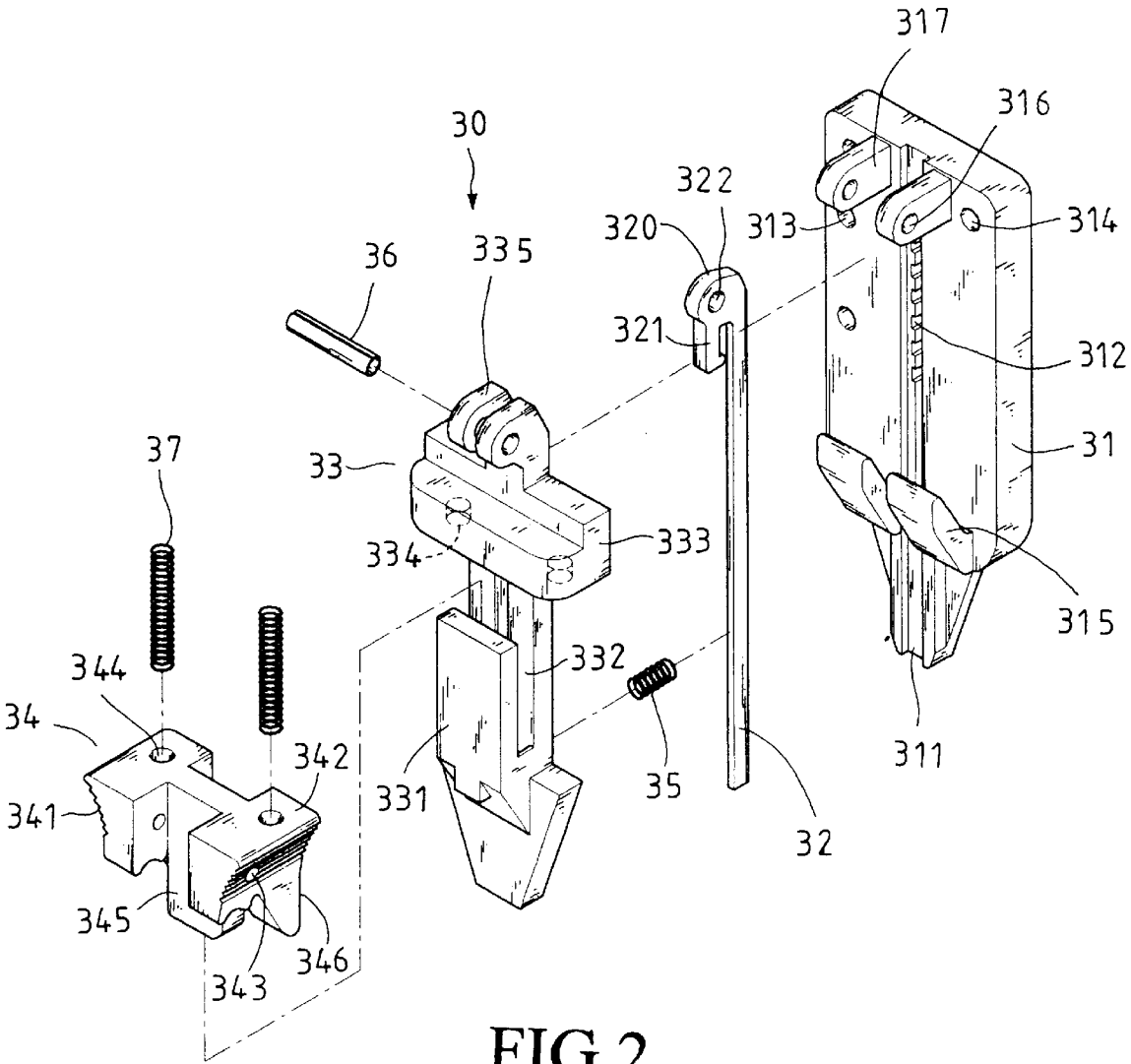
FIG. 2 is an exploded view of the staple ejection device in accordance with the present invention.
Figure 3:
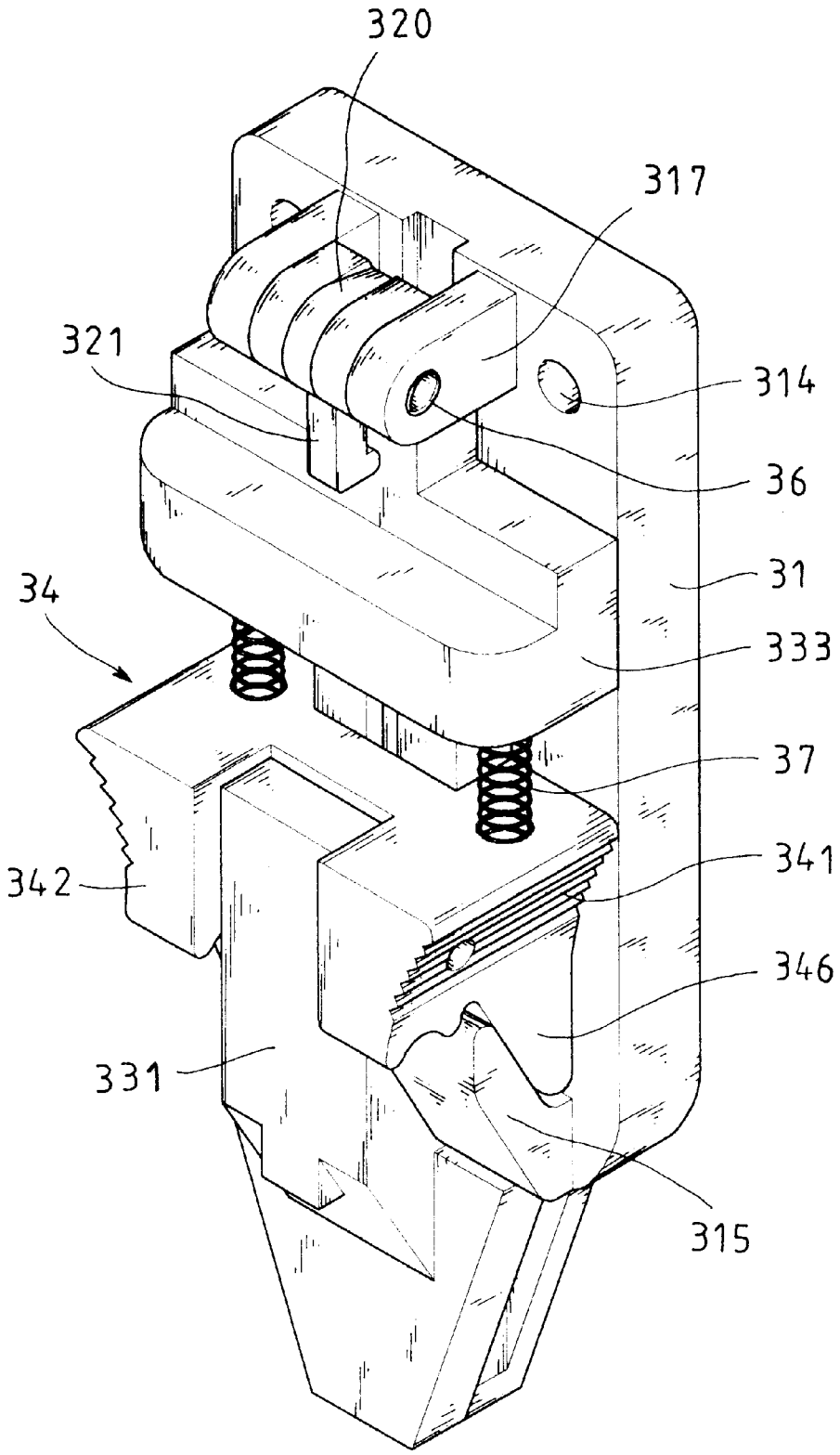
FIG. 3 is a perspective view of the combination of the staple ejection device as shown in FIG. 2 of the present invention.

Referring to FIGS. 1 to 4, the staple ejection device 30 of the present invention for a power stapler 10 comprises a guide plate 31 which is connected to the barrel of the power stapler 10 by extending bolts (not shown) through holes 314 in the guide plate 31, and connected to a magazine 20 by bolts extending through holes 313 in the guide plate 31. A groove 312 is defined in the guide plate 31 so as to receive a strip member 32 therein which is used to guide the staples. A guide tongue 311 extends from the guide plate 31 so that staples are to be ejected from the guide tongue 311. Two hooks 315 and two lugs 317 respectively extend from a surface of the guide plate 31, and each lug 317 has a hole 316 defined therethrough. The strip member 32 has a head 320 through which a hole 322 is defined so that the head 320 is pivotally connected between the two lugs 317 by a pin 36. A catch 321 extends from the head 320.

A cover member 33 has a positioning block 333 on a first end thereof and a retaining plate 331 on a second end of the cover member 33. Two lugs 335 extend from the first end of the cover member 33 so as to be pivotally connected to the two lugs 317 of the guide plate 31 and the head 320 of the strip member 32 by the pin 36. A gap 332 is defined between the retaining plate 331 and the cover member 33. The positioning block 333 has two recesses 334 defined there which face the retaining plate 331. A retaining recess 336 is defined in a rear side of the cover member 33 and which is opposite to the retaining plate 331 so that a spring 35 is received in the retaining recess 336 and biases the strip member 32 as shown in FIG. 5.

A control member 34 has an engaging plate 345 with two buttons 342 connected to two sides of the engaging plate 345. The engaging plate 345 is inserted in the gap 332 and each of the buttons 342 has a dent 344 defined therein so that two springs 37 are engaged between the two pairs of recesses 334 and the dents 344. Therefore, the control member 34 is movably inserted into the gap 332 and each of the two buttons 342 has a cone-shaped end 346 which is engaged with the hook 315 corresponding thereto. In order to facilitate the user to operate the control member 34, the two buttons 342 each have a knurl surface 341 on an outside thereof. The two buttons 342 each further have an aperture 343 defined in the outside thereof so that a tool is inserted into the aperture 343 to operate the control member 34, if necessary.

Figure 5:
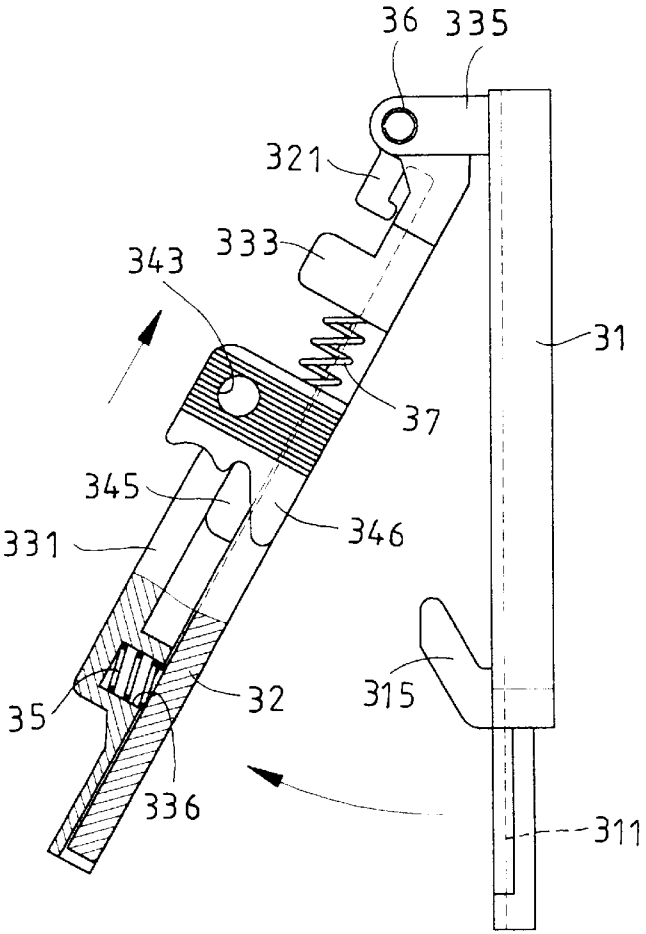
FIG. 5 is a side elevational view, partly in section, of the staple ejection device in accordance with the present invention, wherein the cover member is pivoted away from the guide plate by pulling the control member.
Figure 4:
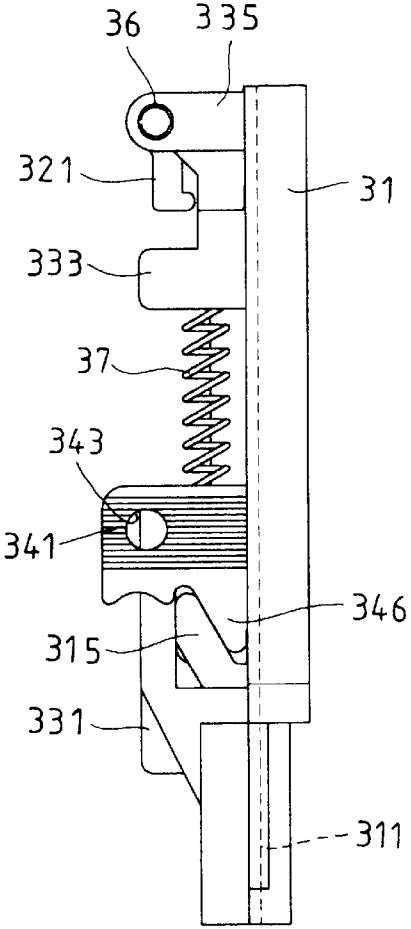
FIG. 4 is a side elevational view to show the staple ejection device in accordance with the present invention.
Figure 6:
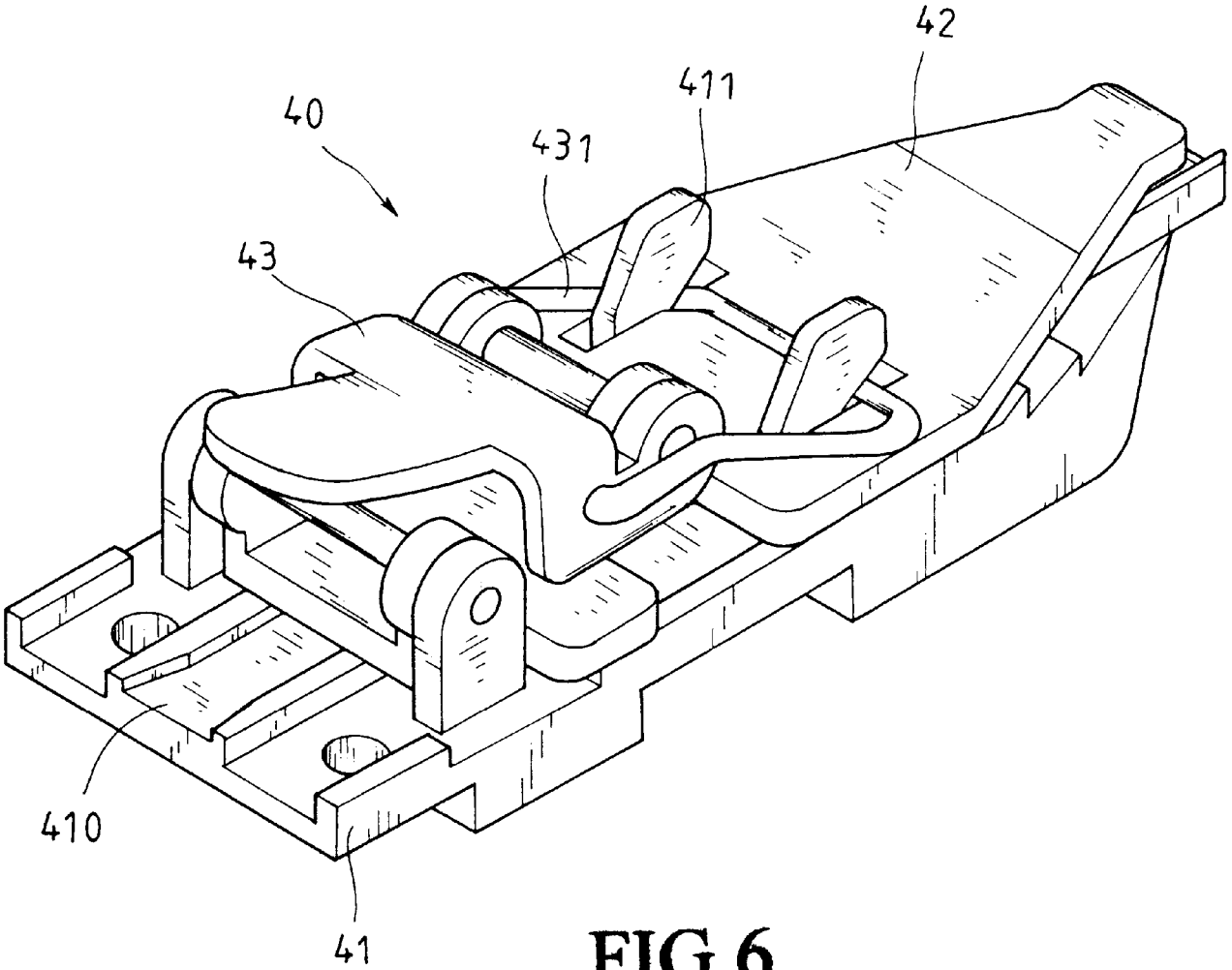
FIG.6 PRIOR ART
FIG. 6 is a perspective view of a conventional staple ejection device.

Referring to FIG. 5, when checking the staples, the user simply pulls the two buttons 342 by fingers so as to compress the springs 37 to disengage the two cone-shaped ends 346 from the hooks 315, then the cover member 33 and the strip member 32 are pivoted away from the guide plate 31. When the head 320 of the strip member 32 is stopped by the guide plate 31 when pivoting the cover member 33, the strip member 32 cannot pivot and the catch 321 contacts the surface of the positioning block 333 so that the cover member 33 cannot pivot either. By this way, the cover member 33 will not separate from the guide plate 31. When pushing the cover member 33 to its original position, the cone-shaped end 346 of each button 342 will slide over the curved surface of the hooks 315 and the springs 37 will push the two buttons 342 to engage with the hooks 315. The spring force of the two springs 37 is not necessarily strong so that the user can easily operate the buttons 342.

The invention is not limited to the above embodiment but various modification thereof may be made. It will be understood by those skilled in the art that various changes in form and detail may made without departing from the scope and spirit of the present invention.

What is claimed is:

1. A staple ejection device for a power stapler, comprising:

a guide plate adapted to be connected to the barrel of the power stapler and a groove defined in said guide plate, two hooks and two lugs respectively extending from a surface of said guide plate, a strip member having one end thereof pivotally connected between said two lugs and received in said groove;

a cover member having a positioning block on a first end thereof and a retaining plate on a second end of said cover member, said first end of said cover member pivotally connected to said two lugs of said guide plate and said end of said strip member, a gap defined between said retaining plate and said cover member, and a control member movably inserted into said gap and having two buttons on two sides of said control member, said two buttons engaged with said two hooks on said guide plate, a biasing means biased between said positioning block and said two buttons.

2. The device as claimed in claim 1, wherein said two buttons each have a cone-shaped end which is engaged with said hook corresponding thereto.

3. The device as claimed in claim 1, wherein said two buttons each have a knurl surface on an outside thereof.

4. The device as claimed in claim 1, wherein said two buttons each have an aperture defined in an outside thereof.

5. The device as claimed in claim 1, wherein said two buttons each have a dent defined in a surface thereof and said positioning block has two recesses defined therein, two springs respectively engaged between said corresponding recess and said dent.

6. The device as claimed in claim 1 further comprising a catch extending from said end of said strip member that is pivotally connected to said two lugs of said guide plate, said catch contacting said positioning block of said cover member.

* * * * *